United States Patent [19]

Hurtes

[11] 3,951,022

[45] Apr. 20, 1976

[54] DEVICE FOR CUTTING AND TRANSPORTING PLURAL ALIGNED FIBERS

[76] Inventor: Walter Hurtes, 433 W. 34th St., New York, N.Y. 10001

[22] Filed: Nov. 14, 1974

[21] Appl. No.: 523,849

Related U.S. Application Data

[62] Division of Ser. No. 331,658, Feb. 12, 1973, Pat. No. 3,850,713.

[52] U.S. Cl. ..... 83/152; 83/158; 83/256; 83/278; 83/404.4; 83/422; 83/808; 214/1 BS

[51] Int. Cl.[2] ..... B26D 3/16; B26D 7/06

[58] Field of Search ..... 83/152, 158, 422, 808, 83/100, 278, 256, 404.4; 214/1 BS; 226/7, 95

[56] References Cited

UNITED STATES PATENTS 3,866,499 2/1975 Messner ..... 83/278

*Primary Examiner*—Frank T. Yost

*Attorney, Agent, or Firm*—Cooper, Dunham, Clark, Griffin & Moran

[57] ABSTRACT

An apparatus and method for cutting compressed oriented fibers held in position by a peripheral sleeve and transporting the fibers from the cutting zone by means of a vacuum belt that contacts the ends of the fibers.

4 Claims, 14 Drawing Figures

FIG. 8
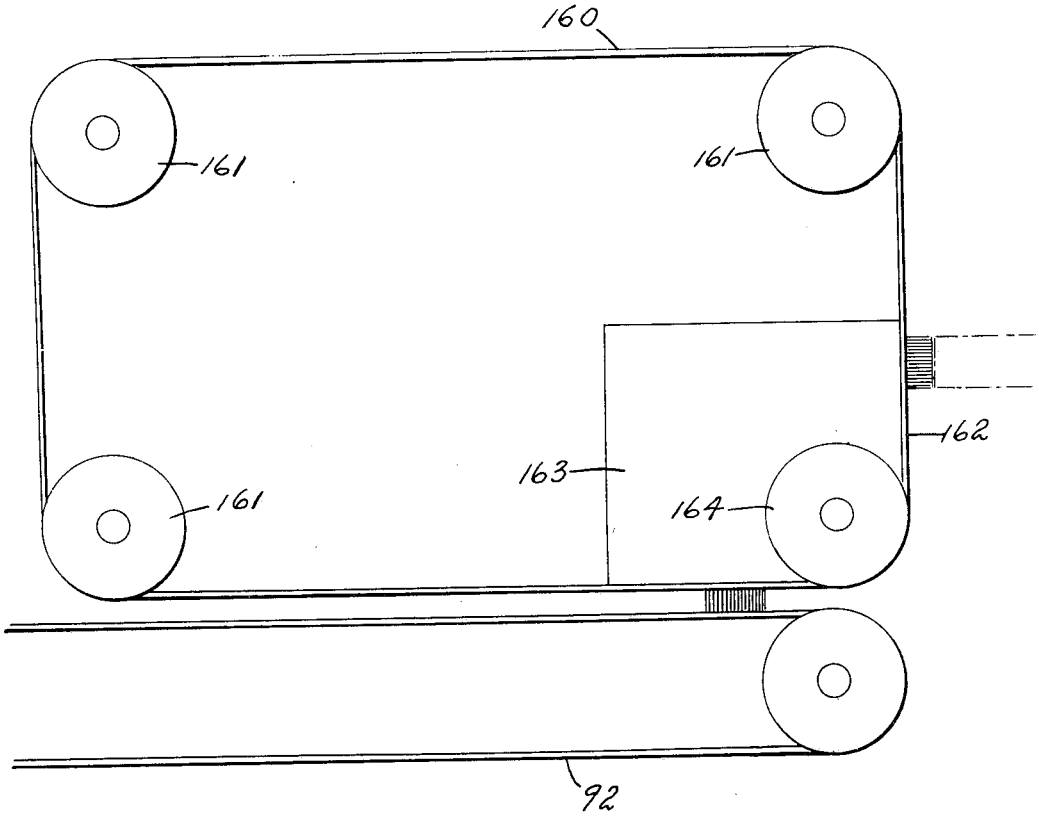
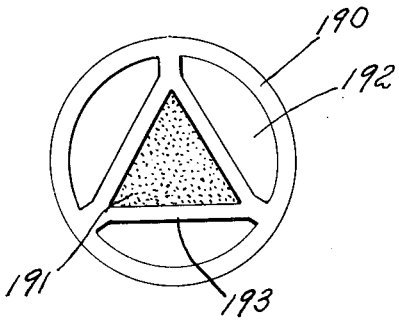
FIG. 6
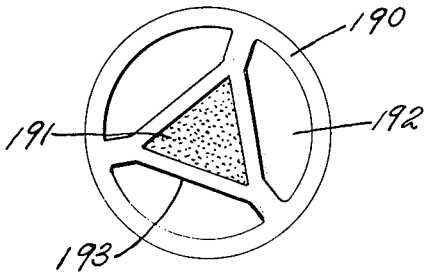
FIG. 7

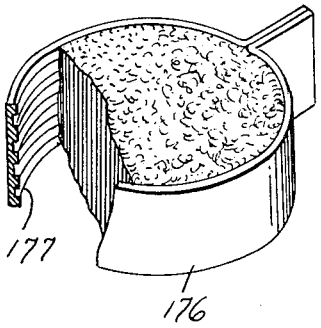
FIG.10
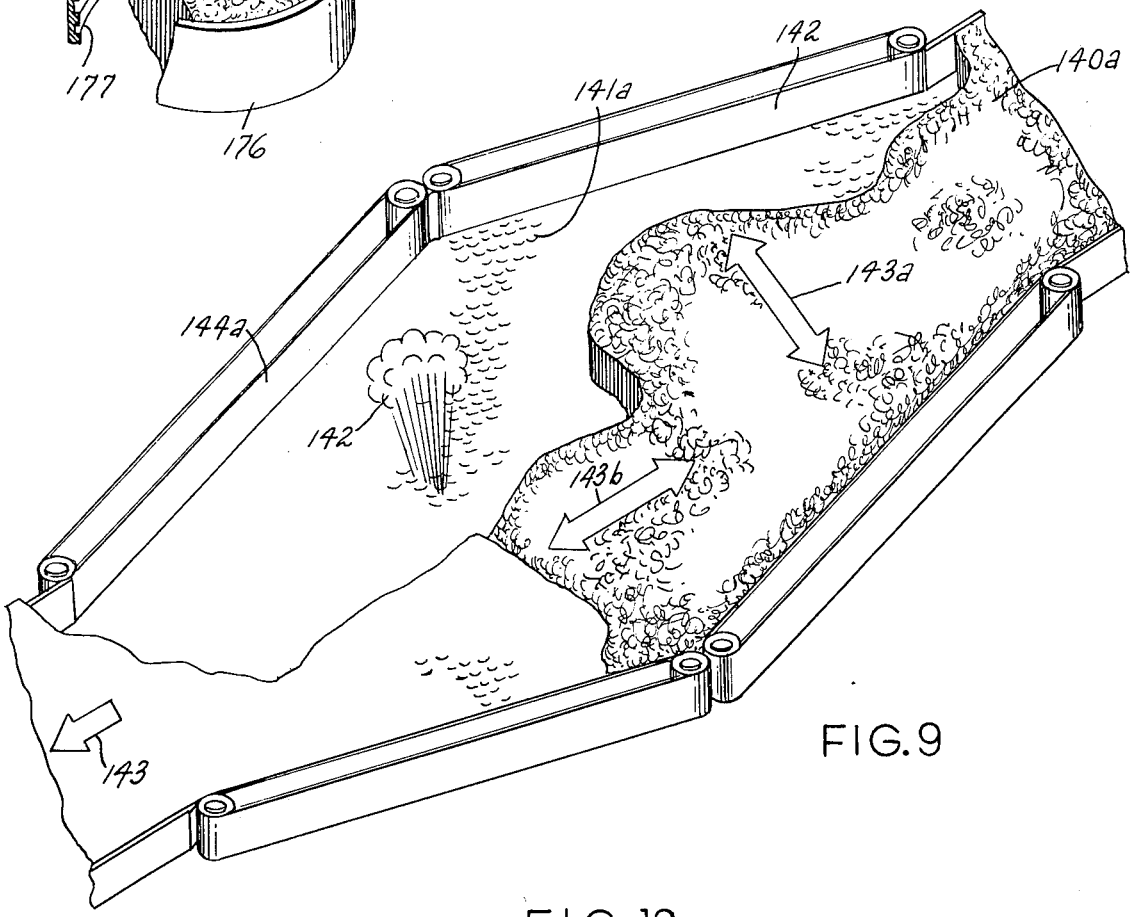
FIG.9
FIG. 12
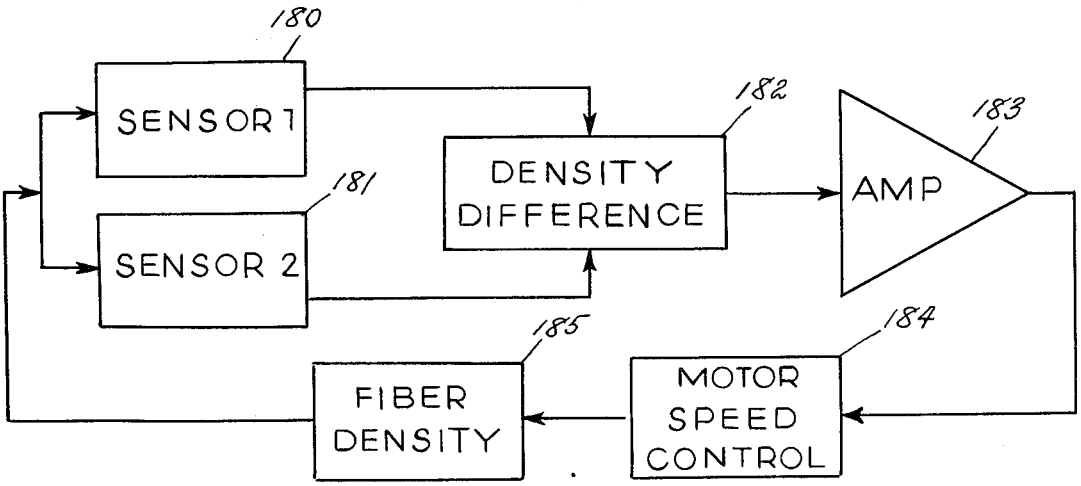

DEVICE FOR CUTTING AND TRANSPORTING PLURAL ALIGNED FIBERS

CROSS-REFERENCE TO RELATED APPLICATION

This application is a division of appliant's copending U.S. patent application Ser. No. 331,658 filed Feb. 12, 1973 for Device for Manufacturing Articles Having a Non-Woven Pile, now U.S. Pat. No. 3,850,713.

BACKGROUND OF THE INVENTION

This invention relates generally to the field of manufacture of non-woven pile articles, and more particularly to an improved device for accomplishing this purpose. Reference is made to my prior U.S. Pat. No. 3,499,807 which discloses the manufacture of such articles manually, and to my copending application Ser. No. 229,065 filed Feb. 24, 1972, now abandoned in favor of application Ser. No. 436,640 filed Jan. 25, 1974, which discloses and claims a related invention.

BRIEF DISCUSSION OF THE PRIOR ART

In the above-mentioned U.S. Pat. No. 3,499,807, the method disclosed contemplates the manufacture of a large number of individual pile-forming units, each including compressed oriented fibers held in position by a peripheral sleeve which is removed when or just prior to when the fibers are adhered upon an adhesively coated surface to which they are attached. This method, while effective, does require a considerable amount of hand labor, which tends to increase the cost of the manufactured articles to a point where they are not competitive with the cost of comparable pile-surfaced articles manufactured by conventional woven or loop methods.

In my copending application, Ser. No. 229,065 mentioned hereinabove, there is disclosed a device for mechanically performing essentially the same operation at a high production rate, exceeding that normally achieved by carpet manufacturing devices of loop-forming type, and far exceeding the rate of production of conventional woven carpets. In this device, the individual pile-forming units, each of which are peripherally enclosed by a severable sleeve or band, are automatically positioned to desired location, the sleeve or band of each unit is then severed and removed, and the fibers comprising the pile are allowed to expand to fill any interstices between adjacent pile units.

One disadvantage of a relatively serious nature which has accompanied the production of non-woven pile articles when using methods taught by both the above-mentioned issued patent and the copending application is the necessity of maintaining a minimum pile height to pile unit diameter. The pile units are in both cases formed by first forming an elongated oriented bundle of fiber enclosed in a thin flexible casing, and subsequently transversely severing the casing much in the manner in which a length of large sausage is severed to form individual slices. While the individual oriented fibers do have a certain affinity for each other, the ability of the peripheral band formed by the slicing operation to maintain the integrity of the unit decreases as it becomes narrower, and the diameter of the pile unit becomes larger. Where a relatively low pile height is desired, the problem may be avoided by making pile units of smaller diameter, but in a mechanized process this practice, which merely avoids the problem rather than solves it, is of limited utility because of the excessively large number of pile forming units which must be employed. Since low pile articles are generally intended to sell at lesser cost than high pile articles, the cost of fabrication, in relation to the cost of materials, becomes excessive.

BRIEF DESCRIPTION OF THE PRESENT INVENTION

Briefly stated, the present invention contemplates a device which forms the elongated lengths of compacted fibers in a severable casing, and which places a plurality of such lengths of fiber-filled tubing in mutually parallel spaced relation such that they can be simultaneously advanced to a cutting station at which point all of the pile units which are required to extend across the width of a completed backing web are simultaneously severed. The length of fiber-filled tubing which is to be cut, projects beyond a supporting housing, and the severing operation is performed while the free ends of the elongated lengths of compressed fiber are held in contact with a vacuum means which supports the free ends of the fibers, while the end to be cut is supported by the housing. The cutter passes close to the supporting housing as the cutting action progresses. Thus, sufficient rigidity is given to the part of the fibers being severed, that the height of the pile unit may be substantially as low as desired. In addition, the mechanical complexity of the device, as compared with that disclosed in the above-mentioned copending application, is materially simplified. In one embodiment in the present disclosure, the severing of fibers to form individual pile units takes place after the removal of the confining band or sleeve, and the fibers are held in laterally compressed relation solely by the presence of vacuum means which engages the free ends of the severed fibers.

BRIEF DESCRIPTION OF THE DRAWINGS

In the drawings, to which reference will be made in the specification, similar reference characters have been employed to designate corresponding parts throughout the several views.

FIG. 6 is a view in elevation showing fiber orienting means employed when pile forming units of a particular pattern are desired.

FIG. 7 is a view in elevation corresponding to that seen in FIG. 6, but showing certain of the component parts in altered relative position.

FIG. 8 is a schematic side elevational view showing a further alternate construction.

FIG. 9 is a fragmentary perspective view showing an alternate construction for expansion of fibers.

FIG. 10 is a fragmentary perspective view illustrating an anisotropic friction material used as film for enclosing fibers to form a pile unit.

FIG. 12 is a schematic view showing a fiber density control means.

DETAILED DESCRIPTION OF THE DISCLOSED EMBODIMENTS

Before entering into a detailed consideration of the disclosed embodiments, a brief review of the methods employed in the prior art is considered apposite.

As set forth in my above-mentioned prior U.S. Pat. No. 3,499,807, the disclosed method includes the steps of forming a plurality of basic pile units, each having a plurality of elongated fibers, the axes of which are aligned to mutually parallel relation, the fibers being surrounded by a sleeve which maintains a plurality of said fibers in relatively compressed condition. These individual units are then placed upon a surface, and within an enclosure preventing expansion of the fibers beyond a desired area when the sleeves are subsequently removed. The ends of the fibers are secured to a desired adhesively coated surface, usually a textile web.

It will be apparent that the method does require considerable hand labor, as well as a degree of skill, both in the formation of the individual units, which is accomplished by radially compressing axially oriented fibers in a cylinder, which cylinder is subsequently severed into short lengths transversely of the principal axis thereof; and the subsequent placing of the individual units on the surface, following which the sleeves are removed. In the abovementioned copending application, these operations are performed mechanically.

The present disclosure contemplates a device operating in a somewhat similar manner, but in which mechanical complexity and operational sequence has been materially simplified.

Figure 1A:
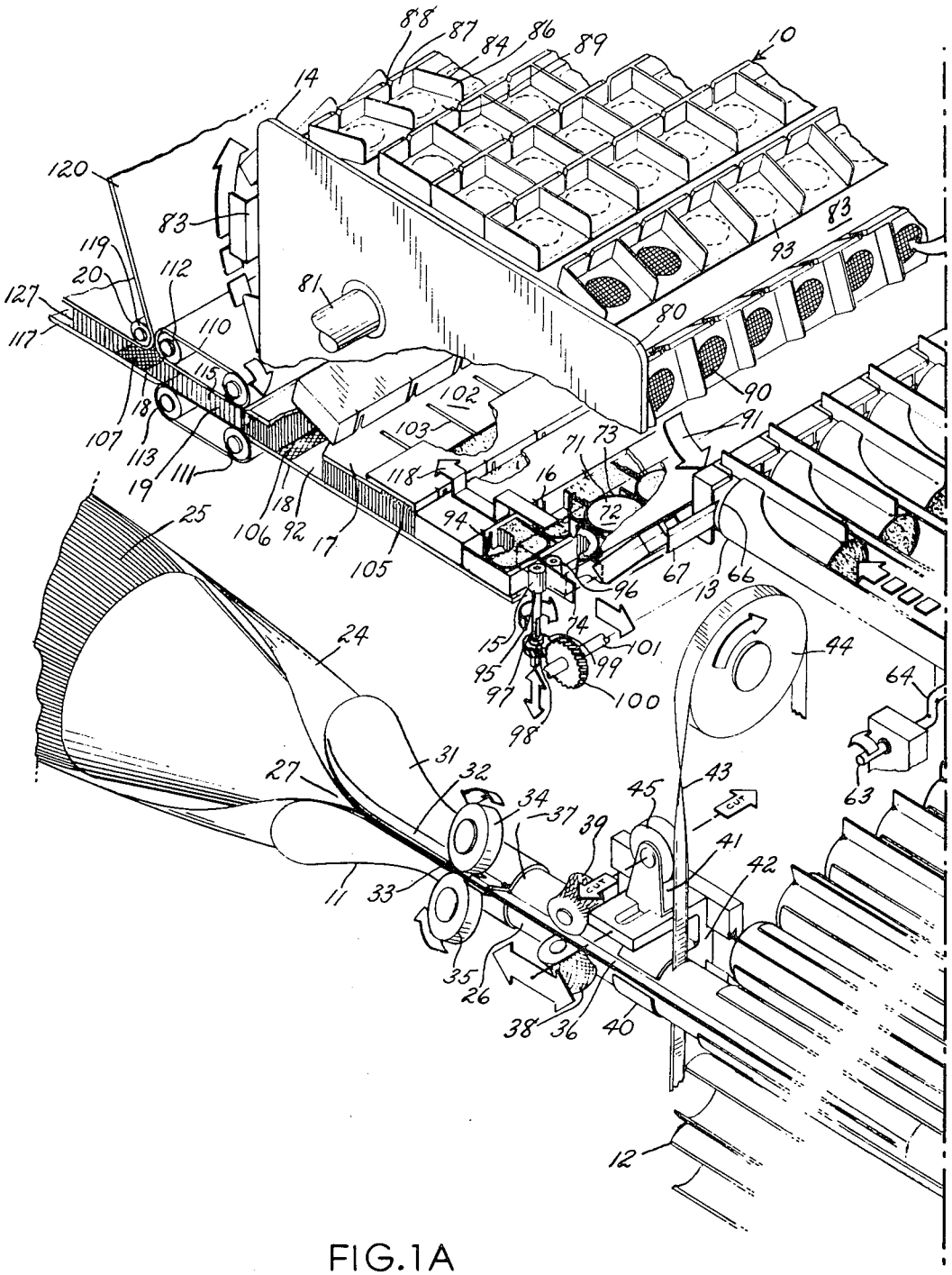
FIGS. 1*a* and 1*b* are a fragmentary view in perspective of an embodiment of the invention.
Figure 1B:
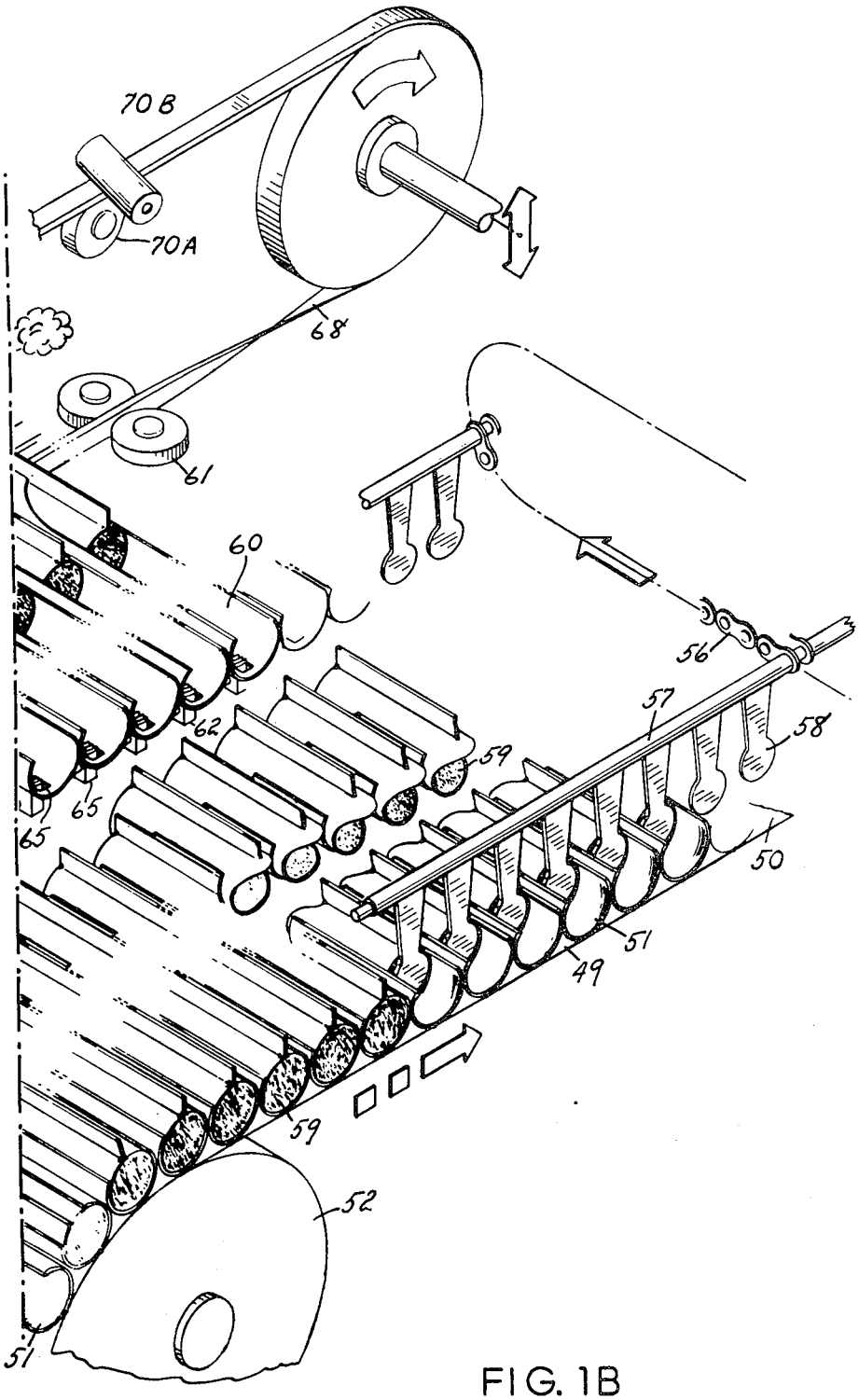

In accordance with the embodiment disclosed in FIGS. 1*a* and 1*b*, the device, generally indicated by reference character 10, comprises broadly: fiber cylinder unit forming means 11, cylinder unit horizontal transfer means 12, cylinder unit longitudinal advancement means and pile unit former 13, transfer, transport and advance mechanism 14, film removal means 15, film cutting means 16, pile stripping means 17, pile density sensing means 18, pile expansion means 19, and web laminating means 20.

Figure 2:
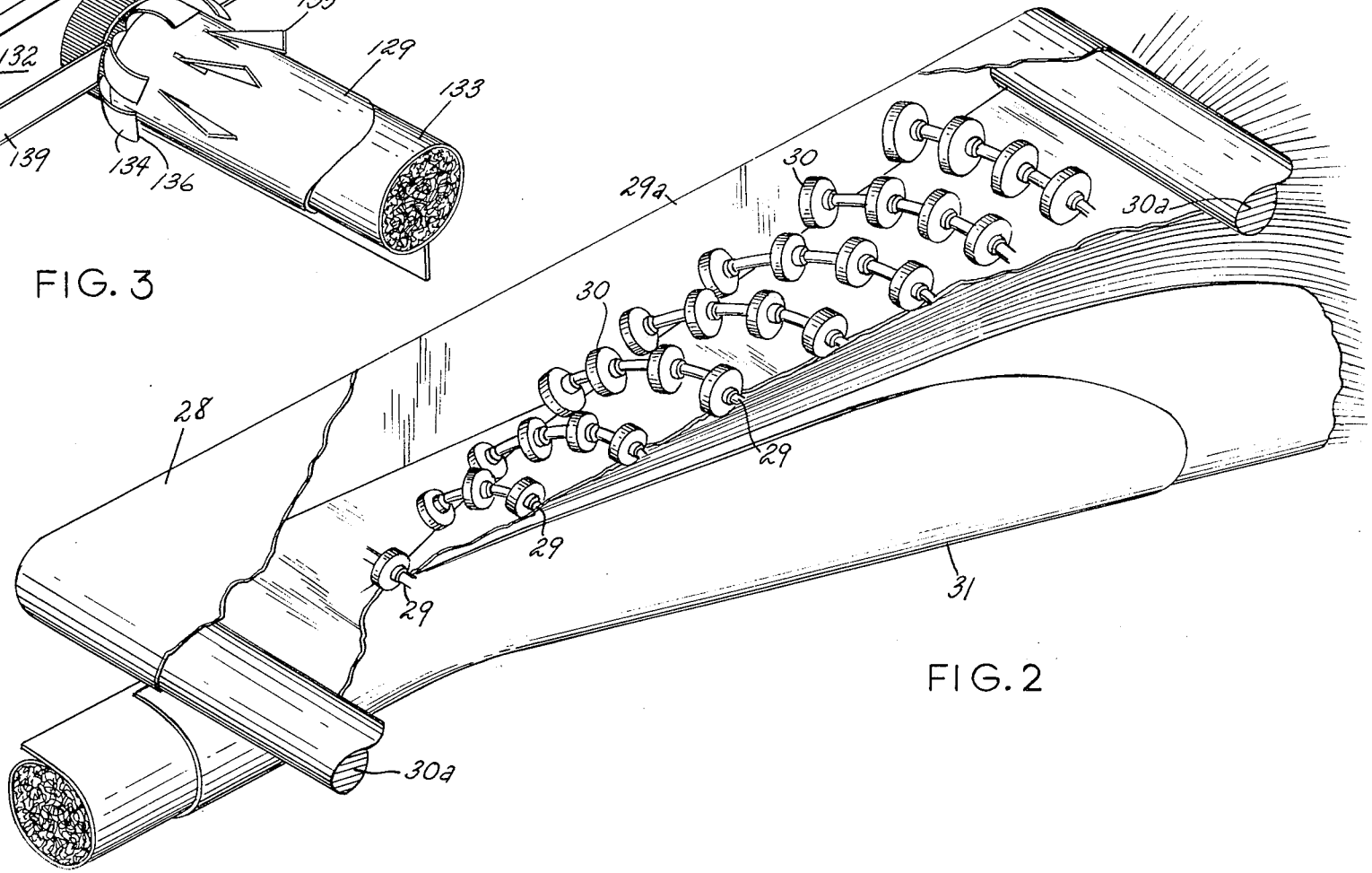
FIG. 2 is a fragmentary view in perspective showing means for radially compressing axially oriented fibers in the formation of an elongated length of encased oriented fibers.

The forming means 11 serves to integrate a continuous length of synthetic resinous film 24 of polyethylene or material possessing similar properties, and oriented spun fiber or tow 25 to form a sausage-like cylindrical unit 26 which is periodically severed into segments of equal length. Disposed in a fiber compression area 27 is a fiber compression means 28 (see FIG. 2) which includes a series of parallel shafts 29 supporting idler rollers 30 which serves to laterally compress continuous lengths of fiber between a film forming funnel-shaped member 31 and an endless belt 29*a*. The belt is supported by a pair of parallel shafts 30*a*, so that the fibers advance with the belt while being compressed to an approximate circular cross section with substantially uniform tension throughout. This construction overcomes the problem of forming a fiber-filled tube in which the relatively centrally disposed fibers are under tension differing from that of fibers which are relatively peripherally located, this situation creating a problem when the fiber-filled tube is transversely cut to form individual pile units, as will be more clearly apparent hereinafter.

The member 31 includes a pair of laterally extending flanges 32 having openings 33 accommodating a pair of heat sealing rollers 34 and 35 which serve to seal the edges of the film 24 and provide a tab in the finished pile unit which functions to orient the unit and form a means for grasping the film surrounding an individual pile unit to facilitate its removal when it is no longer required. Prior to severance into individual pile forming units, the rollers 34–35 form a laterally extending continuous strip 36 which emerges with the remaining parts of the film 24 from the smaller end 37 of the member 31. This movement is of a continuous nature, under the action of feed rollers 38 and 39. The cutting station 40 includes a continuously driven toothless band saw blade 43 which passes over a pulley 44 and is mounted on a dual motion mechanism 41 and 42 with an axial guide member 45. The dual motion guide means 41 and 42 moves the blade both transversely of the axis of the fiber cylinder, and simultaneously advances at the same speed as the feed rollers 38 and 39, thereby cutting the cylinder squarely.

The horizontal advancement means 12 includes a flexible belt 49, the outer surface 50 of which is provided with a plurality of elongated guides 51 each accommodating a cylindrical segment of oriented fibers. The belt 49 is incrementally driven by a pair of rollers, one of which is indicated by reference character 52 under the action of index means (not shown) which permits successive guides 51 to be positioned opposite extruded lengths from the forming means 11.

The incremental advance means 13 includes a pair of endless chains, one of which is indicated by reference character 56, the chains supporting therebetween a plurality of transverse shafts 57 having pendant followers 58 engaging the ends of cylinder segments, generally indicated by reference character 59 to transfer the same to fixed guides 60. Each of the guides 60 is provided with incremental advancement means over its entire length operated by a rotating shaft 63 having offset cranks 64 and toothed snubbers 65. At the forward end 66 of the fixed guides 60 a cutting means 67 is provided, including a toothless band saw 68 and guide rollers, one of which is indicated by reference character 61, which cause the blade to move in a vertical path. A driven roller 70*a* and grinding wheel 70*b* sharpens the blade continuously. The individual pile units 71 are severed, each consisting of oriented compressed fibers 72 and a sleeve or band 73 having a tab 74 thereon.

The transfer and transport mechanism 14 includes a pair of side plates, one of which is indicated by reference character 80, and mounting a pair of transverse shafts, one of which is indicated by reference character 81, each shaft supporting a roller (not shown) in turn supporting an endless belt 83. The outer surface of the belt 83 mounts rows of receptor elements 84, each row including a plurality of individual box-like members bounded by side walls 86, and end wall 87 having a tab receiving slot 88 therein and a base surface 89. Each base surface includes a circular vacuum area 90 to retain a received pile unit 71 until such time as it is deposited on a horizontal endless belt 92, at which time the vacuum is turned off. The movement of the receptor members is along a path indicated by the broad arrow 91, under the action of cam means (not shown) so that at the time a pile unit is received, it abuts the end thereof prior to the severing of the same from the elongated cylinder of which it is a part prior to such severence. Further movement brings the open ends 93 of the members 84 to the film cutting means 16 which comprise piercing blades 94 which pierce the film surrounding each pile unit so that it ruptures, following which nip rollers 95 and 96 of the film cutting means 15 rotate to remove the cut sleeves or bands, and allow the compressed pile fibers to partially expand into a square shape. The nip rollers 95–96 are parallel to each other, the former being mounted on a vertical driven shaft 97 by a spline connection 98 with a pinion 99 meshing with a gear 100 on the shaft 101 which is powered.

The pile stripping means 17 serves to separate the retained pile fibers 105 from the receptor 84 and operates much in the manner of a spatula. It includes a stripping wall 102 having slots 103 accommodating the side walls 86, and comes into action as the receptor members 84 are slightly elevated as indicated by the path of the broad arrow 118. With continued movement of the transfer, transport and advance mechanism, the receptor members move above the now horizontal path of expansion of the fibers. Fibers move leftwardly as seen in FIG. 1*a* to the pile density sensing means 18, at which point they are still relatively compact. Live steam may then be injected through the grillwork which comprises the first station 106, a second station 107 again sensing pile density after partial expansion caused by the steam, and the passage of the partially expanded fibers 115 between the pile expansion means 19 which comprises upper and lower belts 110 and 111 which are driven synchronously by upper and lower rollers 112 and 113, respectively. The increased speed of belts 110 and 111 relative to belt 92 determines how much expansion or contraction will occur at the station. Several stations (not shown) may be used, each causing a further expansion or contraction.

The web laminating means 20 is disposed above a second endless belt 117, on which the expanded fibers 127 continuously advance. A driven roller 119, synchronized with belt 117, is one of a plurality (not shown) which guides an adhesively coated web 120 to contact the upper ends of the fibers, following which the web and adhered fibers move leftwardly into an oven (not shown) a distance sufficient to permit the adhesive coating to cure, following which the web may be suitably spooled or folded as required.

In other applications, where high density of fibers is required, the belts 110 and 111 are driven at a lower speed than belt 92, thereby causing the fibers to compress.

Figure 3:
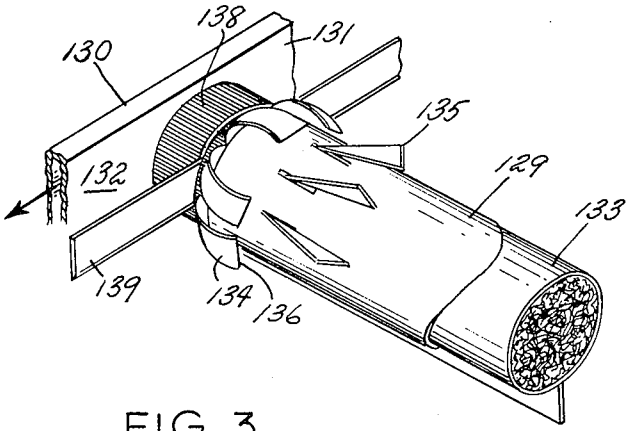
FIG. 3 is a fragmentary view in perspective showing an alternate step in the severing of elongated links of compressed fiber, characterized in the removal of the casing prior to severance.

FIG. 3 illustrates an alternate embodiment of the cutting means comprising the invention which differs from the primary embodiment principally in that the sleeve which surrounds the fiber cylinder is peeled back in banana-like fashion prior to the cutting of the individual pile units. The fiber-filled tube 133 is supported by a housing 129. The free ends of the fibers are close to but not touching the surface 132 of a plate 131 to which a vacuum source 130 is attached. The film 134 which contains the fibers 138 in a state of compression, is slit axially by a cutter 135. The cut ends of the film 136 are grasped by nip rollers which feed the free ends 136 into a vacuum means (not shown) and are held out of the path of the cut-off blade 139. The clearance between the fibers 138 and the surface 132 is equivalent to the thickness of the blade 137. As the cutting action proceeds, the cut fibers are held by the vacuum while the blade completes its cut. The plate 131 advances to the next station and the blade returns to the beginning of its stroke, following which the tube is advanced a distance equal to the height of the pile unit desired to complete the cycle.

Figure 4:
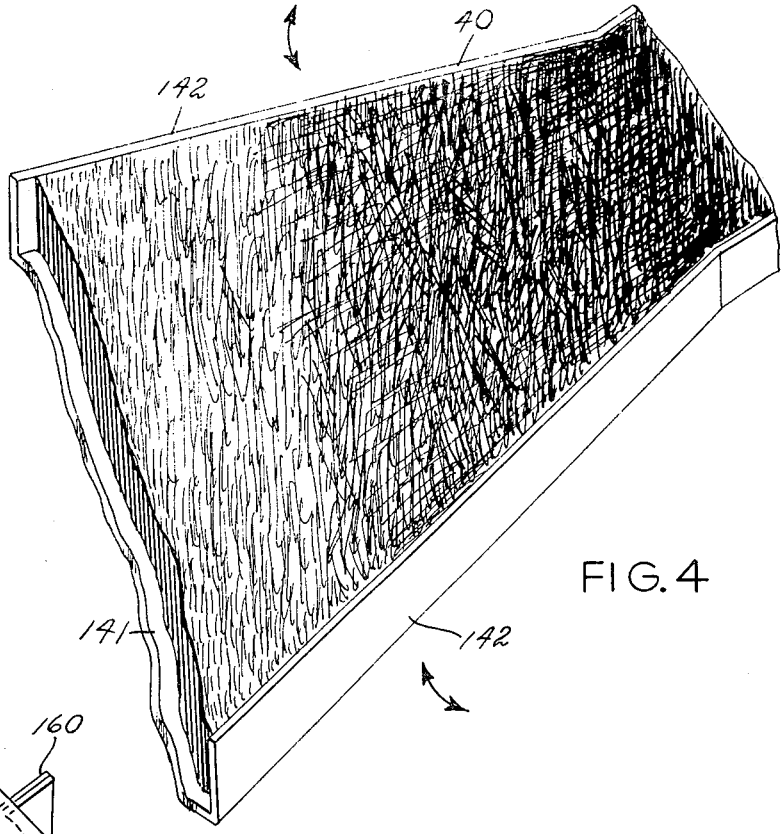
FIG. 4 is a fragmentary view in perspective showing an alternate form of construction facilitating the expansion of fibers useful when working with certain types of oriented fibers.
Figure 5:
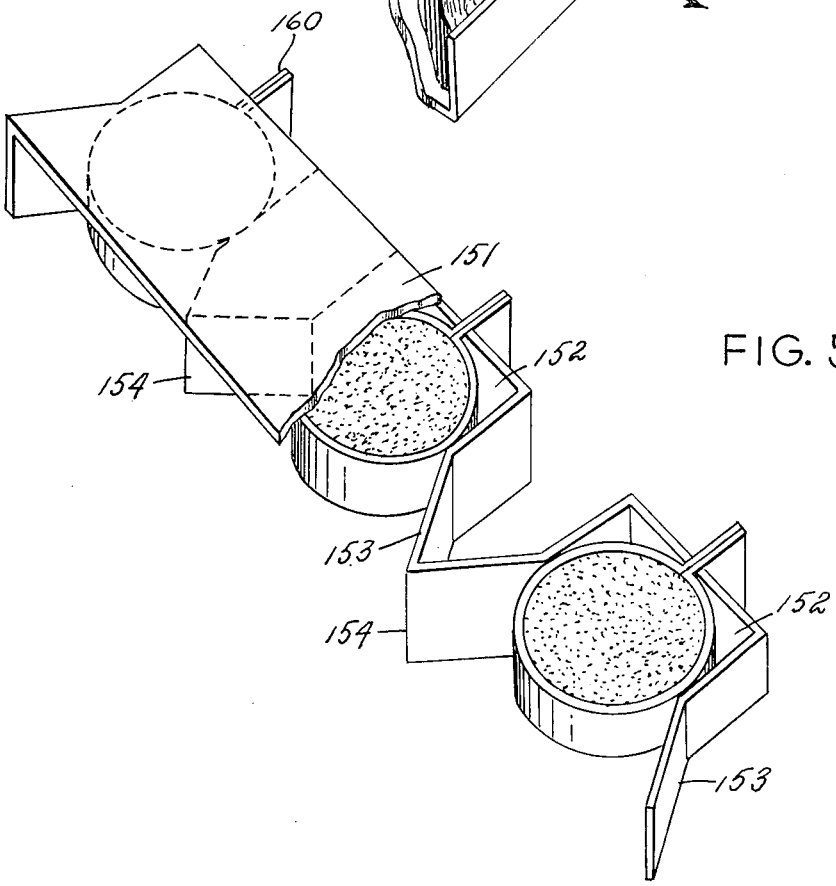
FIG. 5 is a view in perspective showing another alternate form of construction.

FIG. 4 illustrates a modification, generally indicated by reference character 40 which permits even expansion of the fibers by maintaining the vertical fiber retaining walls in diverging relation to reduce fiber-to-wall friction to a minimum. Thus, a fixed horizontal surface 141 is provided with flaring side guides 142, the angle of which is predetermined whereby when the compressed fibers of any given pile unit are released, they may expand with a minimum of friction along the walls. By experimentation, a precise "slip angle" is determined, and the side guides 142 are set accordingly. FIG. 5 shows a somewhat similar principle in which the individual pile units are maintained in spaced lateral relation, rather than juxtaposed, in order to provide adequate room for relatively frictionless expansion. Thus, in this embodiment, generally indicated by reference character 160, the transfer unit 151 includes a plurality of receptor members 152 provided with flaring side walls 153 which converge along lines 154, and which guide lateral expansion of the fibers.

FIG. 9 shows an alternate embodiment of the expansion station which differs primarily in the method by which the fibers are expanded to their final density. The relatively compressed fibers 140*a* are brought in contact with a porous surface 141*a* through which live steam and/or air 142 is injected. The flow rate and pressure of the steam and/or air is controlled such that a fluidized bed of fibers is formed whereby the fibers are levitated and do not touch the surface 141*a*. The fibers are contained laterally by endless belts 142*a* which are driven at the same speed as the fibers, the movement of which is indicated by arrow 143. The divergence of endless belts allows the fibers to expand laterally as well as in the machine direction. In the second state the endless belts 144*a* are arranged in converging relation and cause the fibers to compress laterally back to the original width. However, because the belts move at the same speed as the forward motion of the fibers, and the very low friction between the fibers and the porous plate, the expansion in the machine direction is maintained. The emerging fibers are expanded in the machine direction, and dimensions in the width are restored to the original conditions at entry.

FIGS. 6 and 7 illustrate one of a set of guide plates 190 each having a central opening 191 and peripheral openings 192 formed by septums 193. This guide plate determines the path of fibers prior to the formation of the fiber cylinder, each opening carrying fibers of different color, so that with axial rotation about the center of the plate, the pattern formed by the fiber cylinder may be rotated, to rotate the pattern. Guide plate 190 is sufficiently larger than the compressed fiber cylinder such that the friction effects between the fibers and the guide plates are minimal.

FIG. 8 illustrates a still further simplification of vacuum transfer, and differs from the embodiment shown in FIG. 3 in the provision of a porous belt 160, suitably supported, which passes about rollers 161 and porous roller 164 to present a continuous segment 162 to form part of a vacuum chamber 163. This belt eliminates the need for individual receptor elements, and has the advantage of discontinuing vacuum suction when the belt has moved around to present a horizontal orientation above the belt 92 upon which the fibers expand.

Figure 13:
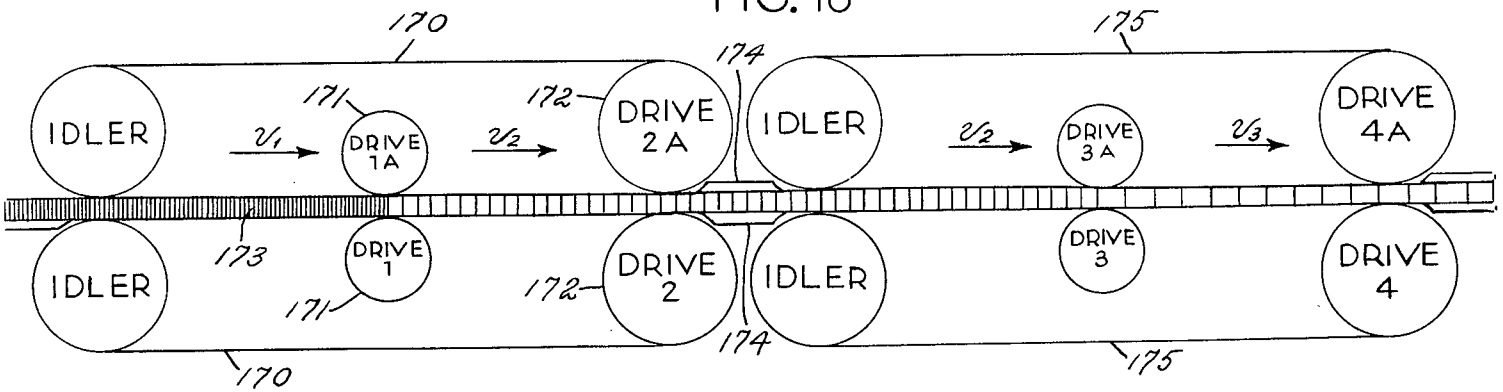
FIG. 13 is a schematic view showing yet another construction for fiber expansion.

FIG. 13 illustrates yet another means for expanding the fibers. Endless belts 170 are made of extensible material such as an elastomer and are driven by two rollers 171 which cause the belts to advance with uniform velocity $V_1$. A second pair of drive rollers 172, which operate at a faster speed than the first pair of rollers, causes the belt to move at a velocity $V_2$ which is greater than $V_1$. The fibers 173 which are densely packed approaching rollers 171 are caused to accelerate across the tangent point of rollers 171 during which time the belts 170 are stretching. The partially expanded fibers advance across transition plates 174 on which a sliding belt is driven at velocity $V_2$ by means not shown. The fibers are thus advanced to a second set of belts 175 which repeats the process until the desired density is attained.

FIG. 10 illustrates a special treatment for the film which encloses the fibers. The film 176 which may be polyethylene or any other suitable material is embossed with grooves 177 the depth of which is approximately 25% of the thickness of the film. The grooves are transverse to the machine direction of the film. When enclosed around the fibers, the grooves will be transverse to the axes of the fibers, thereby greatly increasing the friction between the surface of the film and the peripheral fibers. However, when the film is severed and removed, the grooves will be parallel to the movement of the film, and the grooves will have a minimum effect on the friction between the film and the fibers and will therefore cause the least disturbance to the fibers during removal.

Figure 11:
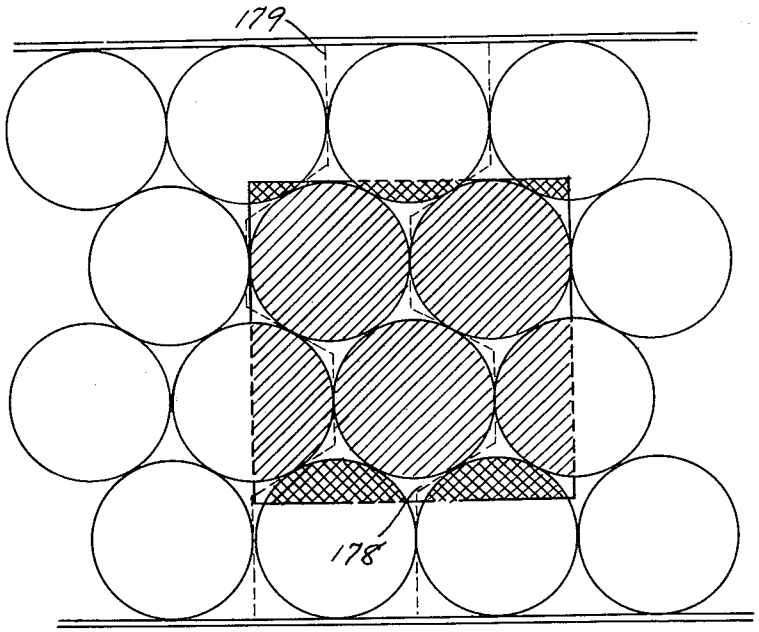
FIG. 11 is a schematic view showing a hexagonal type packing pattern.

FIG. 11 illustrates an arrangement of pile units which results in the minimum space between pile units. The resulting interstice 178 is the minimum area attainable with circular sections of the same diameter, and therefore this arrangement represents the greatest amount of pile units which can be placed in a given area. The embodiment disclosed in FIG. 1 may be structurally modified for the required staggered arrangement of each succeeding line of pile units shown by dashed lines 179.

FIG. 12 is a schematic block diagram showing a means for controlling the density of the fibers. An input sensor 180 is matched against an output sensor 181, which results in a signal 182 proportional to the change in density. This signal is amplified in amplifier 183 and is used to modulate the speed of the drive motor 184, which in turn effects the density of the fibers 185. The density change is sensed by sensors 180 and 181 to complete the feedback loop.

It is to be understood that the invention is not limited to the features and embodiments hereinabove specifically set forth but may be carried out in other ways without departure from its spirit.

I claim:

1. Apparatus for handling fibers, comprising a. means for advancing, to a first locality, an array of substantially axially aligned fibers having free ends disposed substantially in a common plane while maintaining the fibers of said array held together only by lateral compression applied to the periphery of the array;

b. means providing a porous movable surface for simultaneously engaging the free ends of an array of fibers advanced to said first locality by said advancing means while the fibers are held together only by lateral compression as aforesaid and for moving the fibers, in endwise engagement with said surface, from said first locality to a second locality;

c. means for applying suction through said porous surface for securely holding the free ends of an array of fibers against the surface during transfer of the fibers, in endwise engagement with the porous surface, from the advancing means at said first locality to said second locality, said suction-applying means including means for controlling application of suction to release the fibers from the surface at said second locality; and d. means for moving the porous surface between said first and second localities while suction is continuously applied therethrough.

2. Apparatus for cutting fibers, comprising a. a porous surface;

b. means for applying suction through the porous surface;

c. means for advancing a substantially axially aligned array of fibers, having substantially coplanar free ends and held together only by lateral compression applied to the periphery of the array, into endwise engagement with said surface so as to be held by suction applied therethrough; and d. means for transversely cutting the fibers of the array while the fibers are held by suction in endwise engagement with the surface.

3. A method of handling fibers, comprising a. advancing an array of substantially axially aligned fibers, having substantially coplanar free ends, into endwise engagement with a porous surface at a first locality while holding the fibers together only by lateral compression applied to the periphery of the array; and b. applying suction through the porous surface to hold the free ends of the fibers against the surface while c. moving the surface, with the array of fibers held by suction in endwise engagement therewith, from said first locality to a second locality.

4. A method according to claim 3, including the step of terminating application of lateral compression to the periphery of the array upon applying suction as aforesaid.

* * * * *